US005607286A

United States Patent [19]

Takenaka et al.

[11] Patent Number: 5,607,286

[45] Date of Patent: Mar. 4, 1997

[54] STRUCTURE OF PRESSURE PASSAGES BETWEEN CHAMBERS OF A RECIPROCATING TYPE COMPRESSOR

[75] Inventors: Kenji Takenaka; Eiji Tokunaga; Manabu Sugiura, all of Kariya, Japan

[73] Assignee: Kabushiki Kaisha Toyoda Jidoshokki Seisakusho, Kariya, Japan

[21] Appl. No.: 525,981

[22] Filed: Sep. 8, 1995

[30] Foreign Application Priority Data

Sep. 9, 1994 [JP] Japan ..... 6-216381

[51] Int. Cl.[6] ..... F04B 1/26

[52] U.S. Cl. ..... 417/222.2

[58] Field of Search ..... 417/222.2, 269; 91/499, 502, 505

[56] References Cited

U.S. PATENT DOCUMENTS

| | | | |
|---|---|---|---|
| 4,101,249 | 7/1978 | Nakayama et al. | 417/269 |
| 4,381,178 | 4/1983 | Nakayama et al. | 417/269 |
| 4,746,275 | 5/1988 | Iwamori et al. | 417/269 |
| 5,076,764 | 12/1991 | Kawai et al. | 417/269 |
| 5,178,521 | 1/1993 | Ikeda et al. | 417/269 |
| 5,181,834 | 1/1993 | Ikeda et al. | 417/269 |
| 5,240,385 | 8/1993 | Nashiro et al. | 417/222.2 |

*Primary Examiner*—Timothy Thorpe
*Assistant Examiner*—Peter G. Korytnyk
*Attorney, Agent, or Firm*—Brooks Haidt Haffner & Delahunty

[57] ABSTRACT

A compressor has a passage structure for keeping pressure in the crank chamber optimum. A cylinder block has a pressure passage connecting a crank chamber to a suction chamber to regulate the pressure in the crank chamber. The cylinder block has preformed bolt holes for receiving bolts to fix a front housing and a rear housing to the cylinder block. The pressure passage is partially defined by one of the bolt holes.

18 Claims, 7 Drawing Sheets

STRUCTURE OF PRESSURE PASSAGES BETWEEN CHAMBERS OF A RECIPROCATING TYPE COMPRESSOR

BACKGROUND OF THE INVENTION

1. Field of the Invention

The present invention relates to a reciprocating type compressor. More particularly, it pertains to a structure of pressure passages between chambers in a reciprocating type compressor which employs a drive plate to compress refrigerant gas.

2. Description of the Prior Art

In a compressor which employs a drive plate such as a swingable swash plate, the drive plate is mounted on a rotation shaft inside a crank chamber. The rotation of the shaft is converted to the reciprocating movement of pistons in associated cylinder bores by the drive plate. The refrigerant gas, supplied to the cylinder bores from a suction chamber, is compressed by the reciprocating movement of the pistons and then discharged from the compressor via a discharge chamber. Since the crank chamber is defined in a tightly sealed space, it is necessary to maintain the pressure of the chamber within a proper range.

However, a leakage, or blow-by, of compressed gas occurs between the outer cylindrical surface of the pistons and the inner cylindrical surface of the respective cylinder bores. The blow-by gas infiltrates the crank chamber and raises the pressure within. Furthermore, in a variable type compressor, which automatically adjusts an inclining angle of the drive plate, the discharge volume of the compressor is changed by automatically adjusting the pressure inside the crank chamber according to a cooling load. Accordingly, compressors having a structure which discharges the pressure within the crank chamber into other chambers have been proposed. These compressors communicate the crank chamber with the discharge chamber or suction chamber for releasing of the pressure.

Japanese Examined Patent Publication 3-55675 discloses such a compressor. In this compressor, a gas bleeding passage is formed between the suction chamber and the crank chamber. A blow-by of the refrigerant gas in the crank chamber, from the compressing chambers of the cylinder bores, is returned to the suction chamber via the passage. This prevents excessive pressurizing of the crank chamber caused by the blow-by.

In addition, an air intake passage, provided with a release valve, is formed between the discharge chamber and the crank chamber. The valve has a valve control mechanism on which the pressure of the crank chamber acts by way of a pressurizing passage. The opening and closing of the valve is controlled by the mechanism according to the pressure within the crank chamber. The opening and closing of the valve adjusts the pressure inside the crank chamber. This alters the inclining angle of the swing swash plate and controls the discharge volume of the compressed gas.

However, in the above compressor, the gas bleeding passage and the pressurizing passage are formed between neighboring cylinder bores extending along the full length of a cylinder block in its axial direction. Normally, these passages are 2 to 4 mm in diameter and 40 to 50 mm in length. To form these passages which have a long length and small diameter, a drill having a long length and small diameter is required. Therefore, there are cases in which the drill breaks during the formation of these passages. As a result, the machining of these passages is very difficult and troublesome. In addition, means to detect the breakage of the drill such as sensors may become necessary. This raises equipment costs.

SUMMARY OF THE INVENTION

The object of the present invention is to provide a reciprocating type compressor allowing the pressure passages, which communicate between the chambers in the compressor, to be formed by simplified machining in a short period of time.

A further object of the present invention is to provide a reciprocating type compressor which does not require expensive machining equipment.

To achieve the above objects, the improvement of a compressor is herewith proposed. According to the first preferred embodiment, the compressor includes a cylinder block which has a cylinder bore and a plurality of bolt holes respectively receiving bolts to fix a front housing and a rear housing to the cylinder block and define a crank chamber, a suction chamber and a discharge chamber. The crank chamber accommodates a drive plate which is mounted on a drive shaft. The drive plate converts a rotation of the drive shaft into a reciprocating movement of a piston in the cylinder bore to compress gas supplied to the cylinder bore from the suction chamber and discharge the compressed gas to the discharge chamber. The compressor includes a first pressure passage connecting the suction chamber to the crank chamber, said first pressure passage being arranged to release pressure in the crank chamber to the suction chamber so as to regulate the pressure in the crank chamber. The first pressure passage is partially defined by one of the bolt holes.

According to another preferred embodiment, the compressor includes a first pressure passage connects the suction chamber to the crank chamber. The first pressure passage is arranged to release pressure in the crank chamber to the suction chamber so as to regulate the pressure in the crank chamber. The first pressure passage is partially defined by one of the bolt holes. The drive plate is tiltable in respect with an axis according to the pressure in the crank chamber, and wherein a tilting angle of drive plate controls a discharge volume of the compressor. A second pressure passage connects the crank chamber to the discharge chamber to transfer pressure from the discharge chamber to the crank chamber so as to adjust the pressure in the crank chamber. The second pressure passage is partially defined by one of the bolt holes other than the first pressure passage.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments together with the accompanying drawings in which:

DETAILED DESCRIPTION OF THE PREFERRED EMBODIMENTS

A first embodiment of a variable reciprocating type compressor according to the present invention will now be described with reference to FIGS. 1 through 4.

Figure 1:
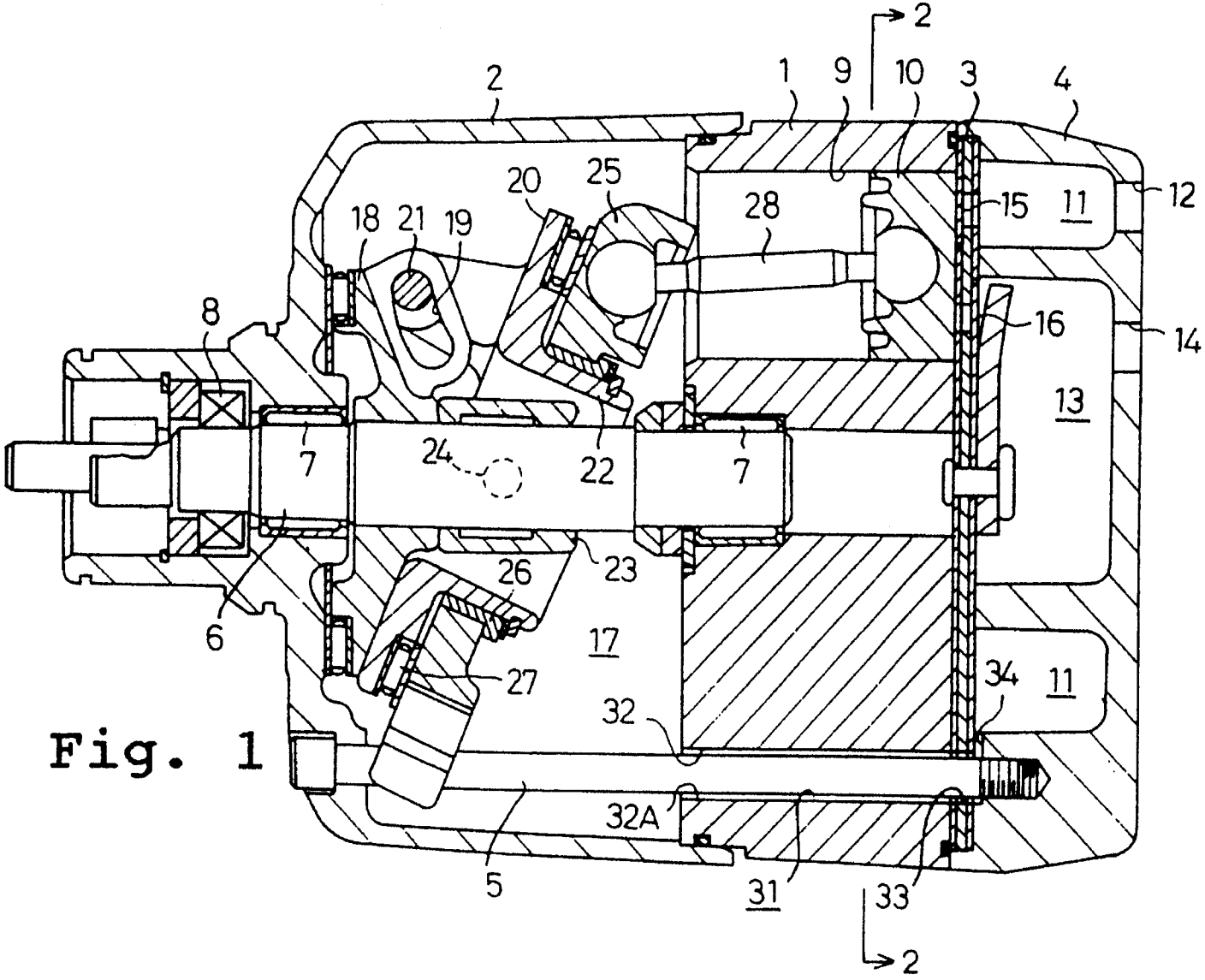
FIG. 1 is a cross-sectional side elevation view showing a variable reciprocating type compressor according to a first embodiment of the present invention.
Figure 2:
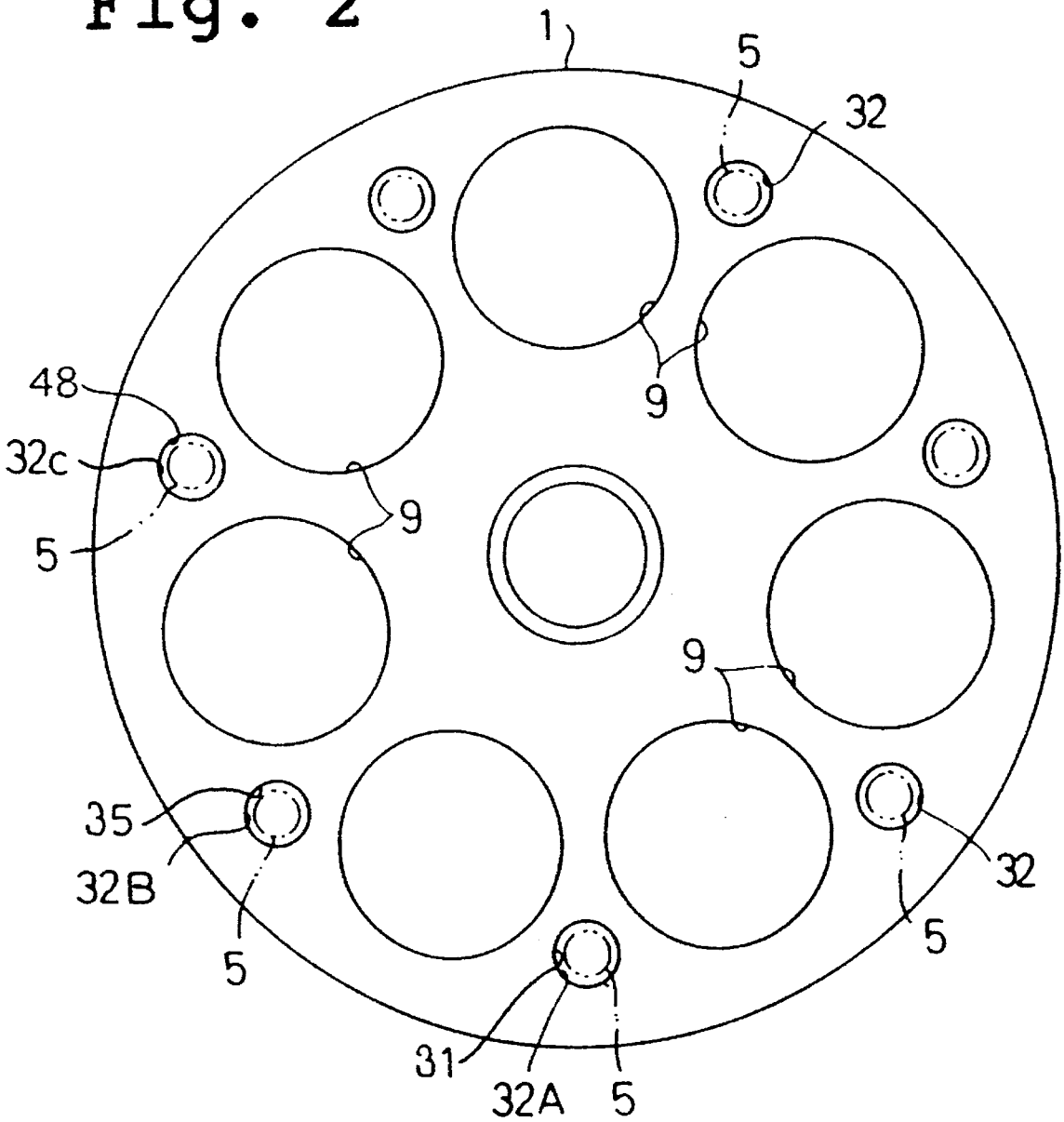
FIG. 2 is a view as seen in the direction of the plane indicated by the line 2—2 of FIG. 1 with some parts omitted.

As shown in FIGS. 1 and 2, a front housing 2 is connected to a front end of a cylinder block 1. A rear housing 4 is connected to a rear end of the cylinder block 1 via a valve plate 3. Both housings 2, 4 and the cylinder block 1 are securely fastened together by a plurality of through bolts 5.

A drive shaft 6 is rotatably supported in the center of the cylinder block 1 and housing 2 by a pair of bearings 7 and a shaft seal apparatus 8. The shaft 6 is connected to and driven by a drive source (not shown) such as an engine. A plurality of cylinder bores 9 are formed in the cylinder block 1 from one end to the other. The bores 9 are arranged about the axis of the shaft 6 at equal intervals. A piston 10 is reciprocally received in each bore 9. The reciprocating movement of the piston 10 within the bore 9 defines a compression chamber having a variable volume.

An annular suction chamber 11 is formed in the rear housing 4 and connected to an external cooling circuit (not shown) via a suction port 12. A discharge chamber 13 is formed in the middle portion of the housing 4 and connected to the cooling circuit via a discharge port 14. A suction valve mechanism 15, provided in the valve plate 3, regulates the intake of refrigerant gas from the suction chamber 11 into each compression chamber. A discharge valve mechanism 16, provided in the valve plate 3, regulates the discharge of refrigerant gas compressed in the combustion chambers into the discharge chamber 13.

A crank chamber 17 is formed in the front housing 2 in front of the cylinder block 1. A rotor 18, accommodated in the crank chamber 17, is fitted on the shaft 6 and rotates integrally with the shaft 6. The rotor 18 has an arm portion on its peripheral portion with a slot 19 formed therein. A swing plate 20, supported by the slot 19 of the rotor 18 through a connecting pin 21, is swingable and rotates integrally with the rotor 18. A boss portion 22 is formed at the center of the plate 20. A sleeve 23, fitted on the shaft 6, is movable along the axial direction of the shaft 6. The sleeve 23 has a pair of pins 24, projecting from its outer circumferential surface, which engage with the boss portion 22 of the plate 20.

A journal bearing 26 and a thrust bearing 27 support a swingable swash plate 25 and allow relative rotation between the plate 25 and boss portion 22 of the plate 20. The bearings 26, 27 also enables integral swinging of the swash plate 25 with the swing plate 20. Engagement between a portion of the plate 25 and one of the bolts 5 restricts rotation of the plate 25. A piston rod 28 connects each piston 10 with the plate 25. Rotation of the shaft 6 swings the plate 25 and reciprocates the pistons 10 by way of the rods 28.

As shown in FIGS. 1 and 2, a gas bleeding passage 31, serving as a first pressure passage, is formed between the suction chamber 11 and crank chamber 17. The passage 31 constantly communicates the suction chamber 11 with the crank chamber 17. The main portion of the passage 31 is formed by a bolt inserting hole 32A. The hole 32A is among one of a plurality of bolt inserting holes 32 provided in the cylinder block for the bolts 5. The hole 32A is formed with a diameter larger than the diameter of the bolt 5. The space defined between the inner wall of the hole 32A and the outer circumferential surface of the bolt 5 forms a portion of the passage 31. The passage 31 also includes a through hole 33 formed in the valve plate 3, and a connecting passageway 34 formed in an inner end of the rear housing 4.

Leakage, or blow-by of the refrigerant gas from the cylinder chambers of the bores 9 to the crank chamber 17 is returned to the suction chamber 11 via the passage 31. This suppresses a pressure increase in the crank chamber 17. The connecting passageway 34 of the passage 31 restricts the flow of refrigerant gas passing through the passage 31 to a predetermined rate.

Figure 3:
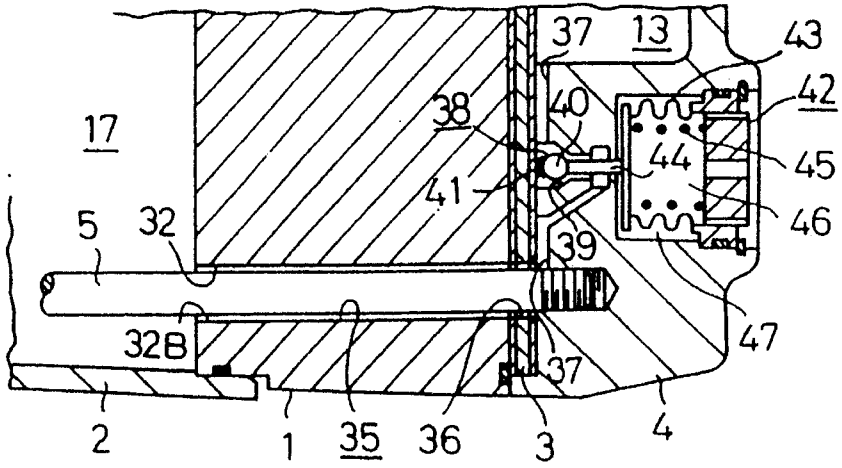
FIG. 3 is a partial cross-sectional view showing a gas intake passage between a discharge chamber and crank chamber, and a release valve which controls the opening and closing of the intake passage.

As shown in FIGS. 2 and 3, a gas intake passage 35, serving as a second pressure passage, is formed between the discharge chamber 13 and crank chamber 17. The passage 35 communicates the discharge chamber 13 with the crank chamber 17. The main portion of the passage 35 is formed by a bolt inserting hole 32B. The hole 32B is among one of the plurality of bolt inserting holes 32 provided in the cylinder block 1. The passage 35 also includes a through hole 36 formed in the valve plate 3, and a passage 37 formed substantially along the inner end of the rear housing 4. In other words, the hole 32B is formed having a diameter larger than the diameter of the bolt 5. The space defined between the inner wall of the hole 32B and the outer circumferential surface of the bolt 5 forms a portion of the passage 35.

A release valve 38 is provided in the passage 37 to open and close the intake passage 35. The valve 38 includes a valve seat 39 formed on a portion of the passage 37, a spherical tip 40 disposed facing the seat 39, and a spring 41 urging the spherical tip 40 towards the seat 39.

Figure 4:
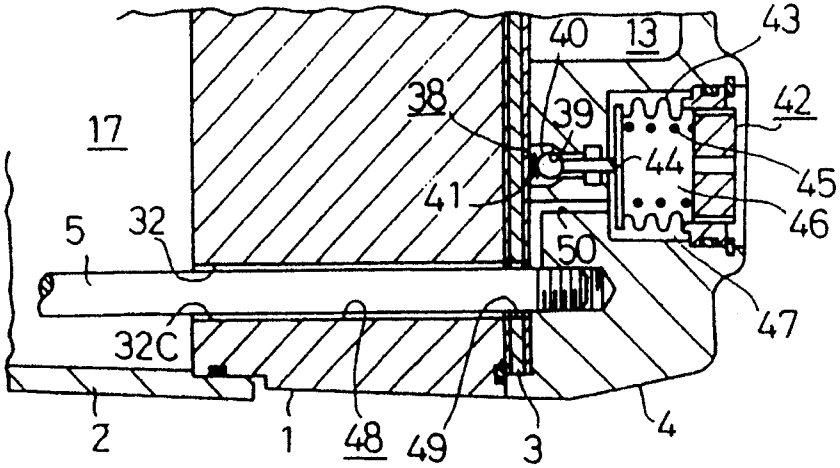
FIG. 4 is a partial cross-sectional view showing a valve control mechanism which controls the opening and closing of a release valve, and a pressurizing passage through which the gas in the crank chamber passes.

As shown in FIGS. 2 through 4, a valve control mechanism 42 is disposed next to the valve 38 to control the opening and closing of the valve 38. The valve control mechanism 42 comprises a bellows 43, an actuating rod 44 mounted between the bellows 43 and the tip 40, and a spring 45 urging the bellows 43 and rod 44 toward the tip 40.

An atmospheric pressure chamber 46 communicated with the atmosphere is defined inside the bellows 43. A pressure detecting chamber 47 is defined outside the bellows 43. A pressurizing passage 48, serving as a pilot passage which pressurizes the detecting chamber 47 to the pressure of the crank chamber 17, is formed between the crank chamber 17 and the detecting chamber 47. The main portion of the passage 48 is formed by a bolt inserting hole 32C. The hole 32C is among one of the plurality of bolt inserting holes 32 provided in the cylinder block 1. The passage 48 also includes a through hole 49 formed in the valve plate 3, and a passage 50 formed in the rear housing 4. In the same manner as the gas bleeding passage 31 and gas intake passage 35, the hole 32C is formed having a diameter larger than the diameter of the bolt 5. The crank chamber 17 is communicated with the detecting chamber 47 by the space defined between the inner wall of the hole 32C and the outer circumferential surface of the bolt 5.

In this embodiment, a positioning structure (not shown) comprises a plurality of positioning holes and positioning pins provided between the cylinder block 1 and front housing 2, and between the cylinder block 1 and rear housing 4. Therefore, the housings 2, 4 are securely positioned with and fixed to each associated end of the cylinder block 1 regardless of the passages 31, 35, 48, defined in the inserting holes 32.

The movement of the variable reciprocating type compressor will now be described.

The pressure of the crank chamber 17 is maintained at a value higher than a designated value when the compressor is not in operation. Accordingly, the bellows 43 of the valve control mechanism 42, detecting the high pressure of the crank chamber 17, is in a contracted state. This contraction holds the spherical tip 40 of the release valve 38 at a position closing the intake passage 35.

As the drive shaft 6, driven by a drive source such as an engine, is rotated, reciprocal swinging of the swash plate 25 by way of the rotor 18 and the swing plate 20 causes reciprocating movement of each piston 10 inside the respective bores 9. The reciprocation of the piston rods 10 forces the refrigerant gas in the suction chamber 11 to be introduced into the compressor chambers of the bores 9 via the suction valve mechanism 15. It also forces the gas compressed by the compression chamber to be discharged out into the discharge chamber 13 via the discharge valve mechanism 16.

During the initial stage of the activation of the compressor, the pressure in the suction chamber 11 is high since the high temperature of a vehicle interior increases the cooling load. Therefore, the pressure in the crank chamber 17 is just slightly higher than the pressure of the suction chamber 11. This increases the inclining angle of the swash plate 25 and reciprocates each piston 10 at its maximum stroke to discharge a maximum volume of compressed refrigerant gas.

In this state, the blow-by gas, which leaks from the compressor chamber of each cylinder bore 9 into the crank chamber 17, is returned to the suction chamber 11 from the crank chamber 17 by way of the gas bleeding passage 31. Thus, an increase in internal pressure of the chamber 17 is suppressed, and the compressor continues discharging a maximum volume of compressed gas.

As the operation of the compressor continues, the lowered temperature of the vehicle interior decreases the cooling load. This decreases the pressure of the suction chamber 11 and lowers the pressure of the crank chamber 17 to a value lower than a designated value. As a result, the bellows 43 of the valve control mechanism 42 is extended. As shown in FIGS. 3 and 4, the extension moves the spherical tip 40 of the valve 38 to a position which opens the gas intake passage 35. Accordingly, the refrigerant gas in the discharge chamber 13 enters the crank chamber 17 via the intake passage 35 and prevents the pressure of the chamber 17 from falling lower than a designated value. This results in a large pressure difference between the crank chamber 17 and the suction chamber 11. The pressure difference reduces the inclining angle of the swash plate 25 and thus makes the stroke of the piston 10 smaller. Consequently, the discharged volume of the refrigerant gas is reduced.

In the compressor of this embodiment, the gas bleeding passage 31, gas intake passage 35, and pressurizing passage 48 are each defined within the respective bolt inserting hole 32A, 32B, 32C. Therefore, these passages 31, 35, 48 are formed in the cylinder block 1 by machining the inserting holes 32A, 32B, 32C with a diameter larger than the bolts 5. As a result, the machining of long holes having a small diameter between each cylinder bore 9 using a drill having a long length and small diameter, as in the manufacture of conventional compressors, has become obsolete.

More specifically, since the inserting holes 32 are relatively large, the holes 32 may be formed during the casting of the cylinder block 1. The inner surface of the holes 32 are than finished by machining. Hence, the machining of the holes 32 is simplified. The holes 32 may also be formed by using a drill with a large diameter. This allows the passages 31, 35, 48 to be machined within a short period of time without breakage of the drill bits. Additionally, these passages 31, 35, 48 are not required to be formed separately from the holes 32. This enables simplification of the machining process and reduces the machining time of the cylinder block 1.

Furthermore, since the passages 31, 35, 48 are not required to be formed individually in the cylinder block 1, the block 1 may be made compact. This permits the production of a smaller compressor.

In this embodiment at least one of the passages 31, 35, 48 may be formed in the bolt inserting holes 32.

Figure 5:
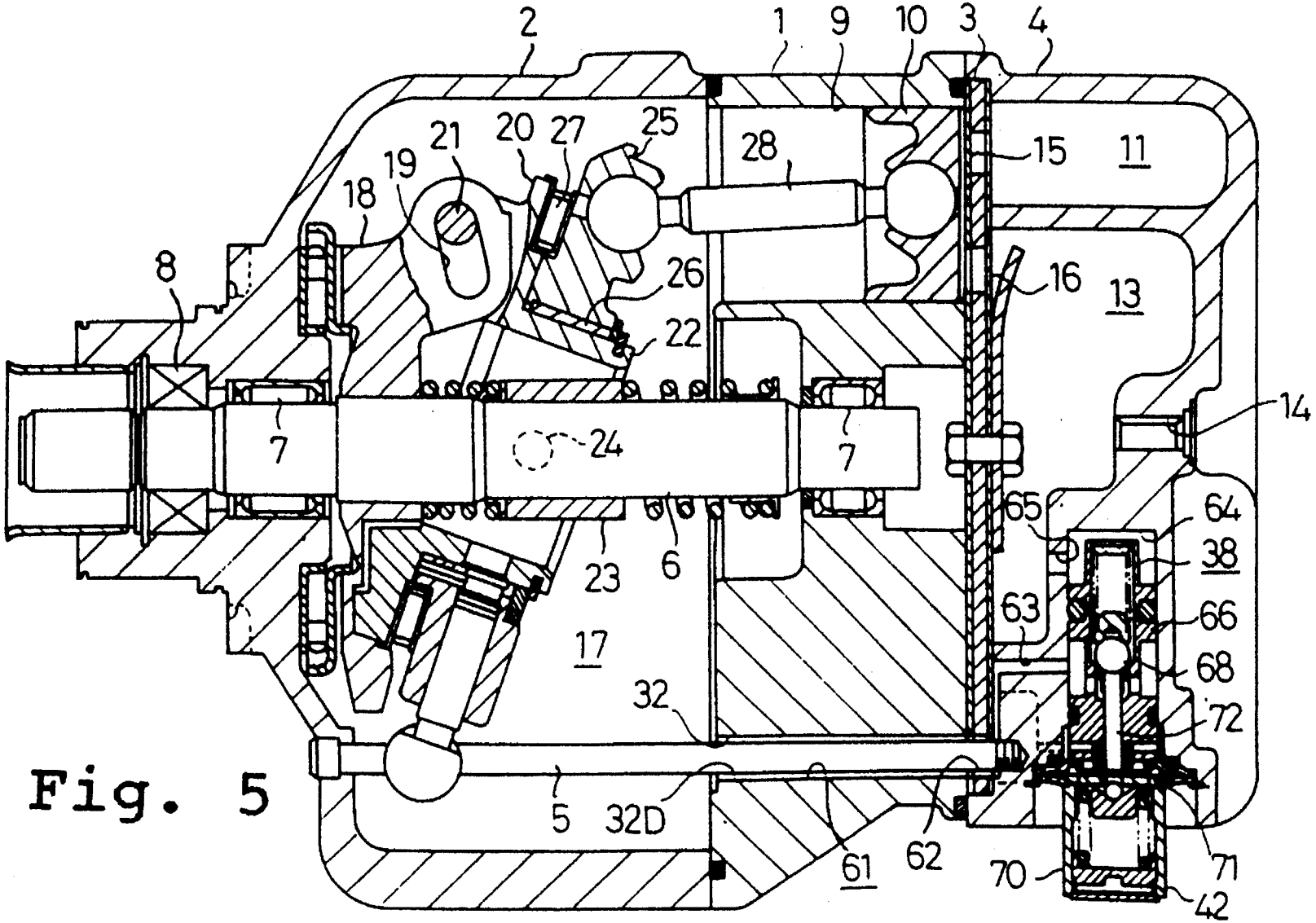
FIG. 5 is a cross-sectional side elevation view showing a variable reciprocating type compressor according to a second embodiment of the present invention.
Figure 6:
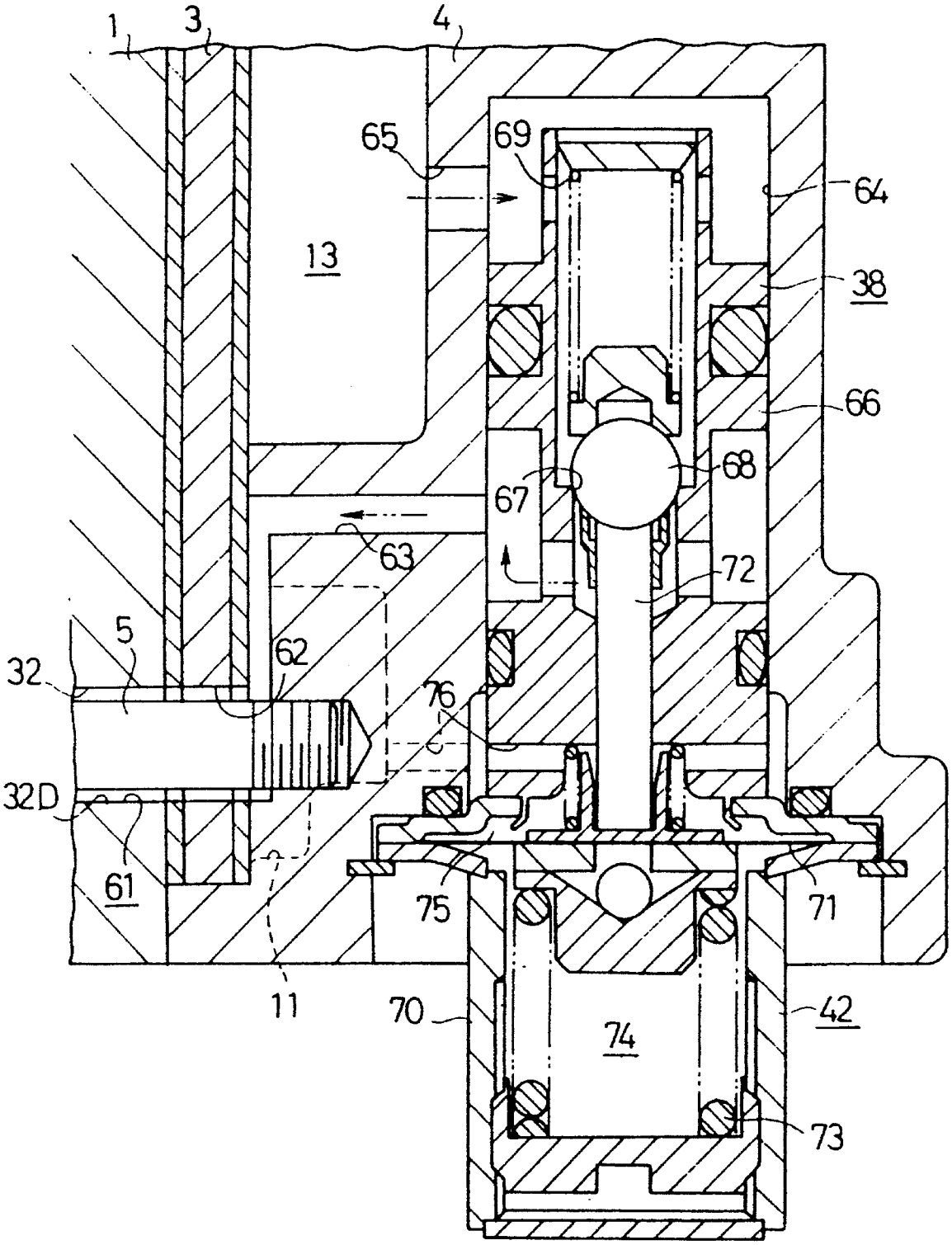
FIG. 6 is an enlarged partial cross-sectional view of the compressor of FIG. 5 showing a gas intake passage between a discharge chamber and crank chamber, and a release valve which controls the opening and closing of the intake passage.

A second embodiment of the variable reciprocating type compressor according tot he present invention will now be described with reference to FIGS. 5 through 7.

In the same manner as in the first embodiment, a gas intake passage 61 communicating the discharge chamber 13 with the crank chamber 17 is formed between the chambers 13, 17. The main portion of the passage 61 is formed by a bolt inserting hole 32D provided in the cylinder block 1. The passage 61 includes a through hole 62 formed in the valve plate 3, a passage 63 formed in the rear housing 4, an accommodating hole 64 communicated with the passage 63, and a passage 65 connecting the hole 64 with the discharge chamber 13. The hole 32D is formed having a diameter larger than the diameter of the bolt 5.

A release valve 38 is provided in the passage 61. The valve includes a casing 66 accommodated within the hole 64, a valve seat 67 formed in the casing 66, a spherical tip 68 disposed facing the seat 67, and a spring 69 urging the tip 68 towards the seat 67.

A valve controlling mechanism 42, which controls the opening and closing of the valve 38, is disposed next to the valve 38. The mechanism 42 includes a constant pressure case 70, a diaphragm 71 stretched over the opening of the case 70, an actuating rod 72 mounted between the diaphragm 71 and the spherical tip 68, and a spring 73 urging the tip 68, through the diaphragm 71 and rod 72, towards an open position.

A constant pressure chamber 74 and a pressure detecting chamber 75 are formed in the case 70, partitioned from each other by the diaphragm 71. A pressurizing passage 76, formed in the rear housing 4 and casing 66, is provided between the suction chamber 11 and the detecting chamber 75. The detecting chamber 75 is pressurized to the suction pressure of the suction chamber 11 through the passage 76.

Figure 7:
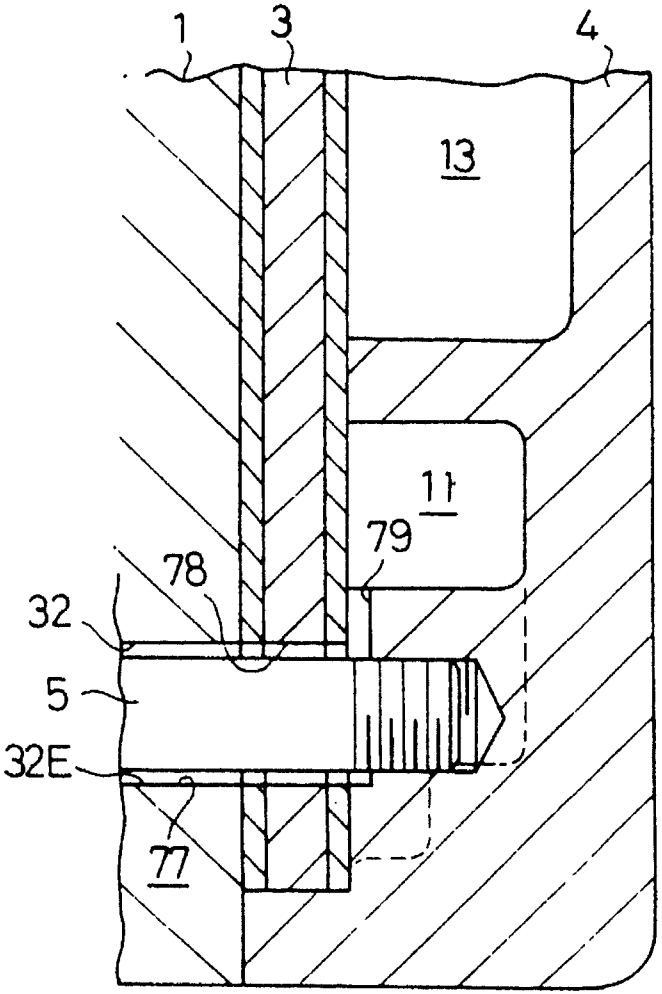
FIG. 7 is an enlarged partial cross-sectional view showing a gas bleeding passage between a suction chamber and crank chamber.

As shown in FIG. 7, a gas bleeding passage 77 communicating the suction chamber 11 with the crank chamber 17 is formed between the chambers 11, 17. The main portion of the passage 77 is formed by a bolt inserting hole 32E provided in the cylinder block 1. The passage 77 includes a through hole 78 formed in the valve plate 3 and a connecting passageway 79 formed in the inner end of the rear housing 4. The hole 32E is formed having a diameter larger than the diameter of the bolt 5. The connecting passageway 79 of the passage 77 restricts the flow of the refrigerant gas passing through it to a predetermined rate.

In this embodiment, when the compressor is not in operation, the pressure of the suction chamber 11, discharge chamber 13, and crank chamber 17 are the same. This causes the tip 68 of the release valve 38 to abut against the valve seat 67, with the urging force of the springs 69, 73 in a balanced state, and close the passage 61.

When the operation of the compressor is commenced, rotation of the drive shaft 6 reciprocally swings the swash plate 25 and causes the reciprocating movement of each piston 10 inside the respective bores 9. The reciprocating movement of the piston rods 10 forces the refrigerant gas to be introduced into the compression chambers, defined in the bores 9, from the suction chamber 11 and then discharges the compressed gas out to the discharge chamber 13.

During the initial stage of activation of the compressor, the pressure in the suction chamber 11 is high due to the high cooling load. A high suction pressure acts on pressure detecting chamber 75 of the valve controlling mechanism 42 by way of the pressurizing passage 76. Therefore, the tip 68 of the release valve 38 is maintained in a state in which the gas intake passage 61 is closed. This prevents the refrigerant gas in the discharge chamber 13 from entering the crank chamber 17. Furthermore, the blow-by gas leaking into the crank chamber 17 from the compressing chambers of the cylinder bore 9 is returned to the suction chamber 11 via the gas bleeding passage 77. Accordingly, the pressure difference between the pressure of the crank chamber 17 and the suction pressure is small. This increases the inclining angle of the swash plate 25 and thus operates the compressor to discharge a large volume of compressed refrigerant gas.

As the operation of the compressor continues, the lowered temperature of the vehicle interior decreases the cooling load. This decreases the pressure of the suction chamber 11 and also lowers the pressure of the pressure detecting chamber 17 of the valve controlling mechanism 42. Hence, the tip 68 of the release valve 38 moves away from the valve seat 67 via the actuating rod 72 and opens the gas intake passage 61. Accordingly, the refrigerant gas in the discharge chamber 13 enters the crank chamber 17 via the intake passage 61 and increases the pressure difference between the crank chamber 17 and the suction pressure. This results in a large pressure difference between the crank chamber 17 and the suction chamber 11. The pressure difference reduces the inclining angle of the swash plate 25 and thus makes the stroke of the piston 10 smaller. Consequently, the discharged amount of compressed gas is reduced.

In the compressor of this second embodiment, the passages 61, 77 are formed in the bolt inserting holes 32D, 32E provided in the cylinder block 1. As a result, a drill having a long length and small diameter is not required. Therefore, the same benefits of the first embodiment, such as the easy formation of the passages 61, 77 within a short period of time are also obtained in the compressor of this embodiment.

In the second embodiment, both passages 61, 77 are formed in the bolt inserting holes 32. However, only one of the passages 61, 77 may be formed in any one hole 32.

Figure 8:
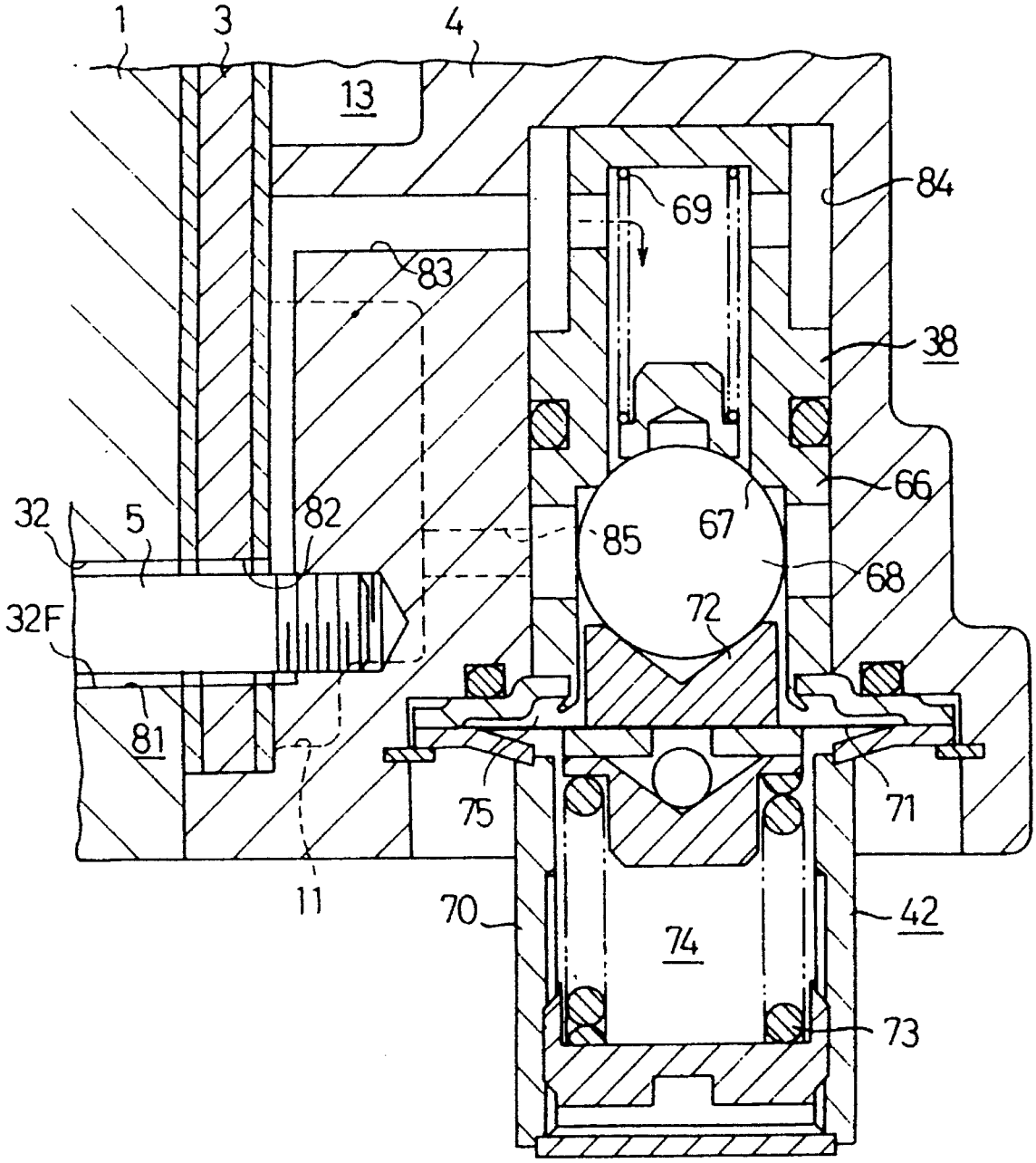
FIG. 8 is an enlarged partial cross-sectional view of a variable reciprocating type compressor according to a third embodiment of the present invention showing a gas bleeding passage between a suction chamber and crank chamber, and a release valve which controls the opening and closing of the bleeding passage.

A third embodiment of the present invention will be described with reference to FIGS. 8 and 9.

In this embodiment, a gas bleeding passage 81 communicates the suction chamber 11 with the crank chamber 17. The main portion of the passage 81 is formed by a bolt inserting hole 32F which is provided in the cylinder block 1. The passage includes a through hole 82 formed in the valve 3, a passage 83 formed in the rear housing 4, an accommodating hole 84 which communicates with the passage 83, and a passage 85 which connects the hole 84 with the suction chamber 11. The inserting hole 32F is formed having a diameter larger than the diameter of the bolt 5.

The release valve 38, for opening and closing of the passage 81, is provided in the accommodating hole 84 of the passage 81. As in the second embodiment, the valve 38 includes the casing 66, valve seat 67, the spherical tip 68, and spring 69. However, the valve 38 is different from the second embodiment in the point that the spring 69 urges the tip 68 away from the seat 67.

A valve controlling mechanism 42, which controls the opening and closing of the valve 38, is disposed next to the valve 38. As in the second embodiment, the mechanism 42 includes the constant pressure case 70, diaphragm 71, actuating rod 72, and spring 73. However, the mechanism 42 is different from the second embodiment in the point that the tip 68 is urged toward the seat 67 by the spring 73. Furthermore, as in the second embodiment, the constant pressure chamber 74 and pressure detecting chamber 75 are formed in the case 70 partitioned from each other by the diaphragm 71. The detecting chamber 75 communicates with the suction chamber 11 via the passage 85 of the bleeding passage 81.

Figure 9:
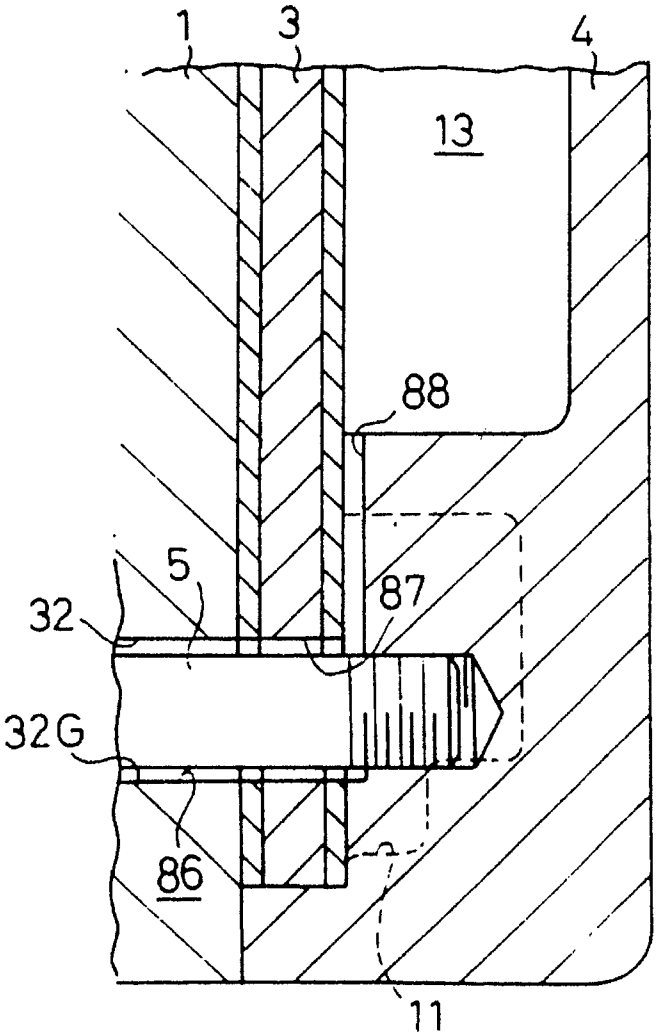
FIG. 9 is an enlarged partial cross-sectional view of the compressor of FIG. 8 showing a gas intake passage between a discharge chamber and crank chamber.

As shown in FIG. 9, a gas intake passage 86 is formed between the discharge chamber 13 and crank chamber 17. The passage 77 communicates the discharge chamber 13 with the crank chamber 17. The main portion of the passage 86 is constituted by a bolt inserting hole 32G provided in the cylinder block 1. The passage 86 also includes a through hole 87 formed in the valve plate 3, and a connecting passageway 88 formed in the inner end of the rear housing 4. The hole 32G is formed having a diameter larger than the diameter of the bolt 5. Furthermore, the connecting passageway 88 of the passage 86 restricts the flow of the refrigerant gas to a predetermined rate.

In the compressor of the third embodiment, the tip 68 of the release valve 38 is moved to a position opening the bleeding passage 81 when the cooling load and pressure of the suction chamber 11 are high. This allows the refrigerant gas in the crank chamber 17, which is a blow-by gas from the compressor chambers of the cylinder bores 9 or is supplied from the discharge chamber 13, to be released into the suction chamber 11. Accordingly, the small pressure difference between the pressure of the crank chamber 17 and the suction pressure causes the swash plate 25 to be inclined to a maximum angle thereby discharging a maximum volume of compressed refrigerant gas from the compressor.

As the cooling load decreases and lowers the pressure of the suction chamber 11, the pressure in the pressure detecting chamber 75 is also decreased. This causes the tip 68, urged by the spring 73, to close the bleeding passage 81. Therefore, the flow of the refrigerant gas, from the crank chamber 17 via the passage 81, is blocked. As a result, the blow-by gas from the compressor chambers of the cylinder bores 9 and the supply of refrigerant gas from the discharge chamber 13 via the gas intake passage 86 raises the pressure of the crank chamber 17. Accordingly, the difference between the pressure of the crank chamber 17 and the suction pressure makes the stroke of the pistons 10 smaller and reduces the discharge volume of the refrigerant gas.

In the compressor of this third embodiment, the passages 81, 86 are formed in the bolt inserting holes 32F, 32G provided in the cylinder block 1. As a result, a drill having a long length and small diameter is not required. Therefore, the same benefits of the first and second embodiments, such as the easy formation of the passages 81, 86 within a short period of time are also obtained in the compressor of this embodiment.

In the third embodiment, both passages 81, 86 are formed in the bolt inserting holes 32. However, only one of the passages 81, 86 may be formed in a hole 32 instead.

Although the present invention has been described in the embodiments herein, it should be apparent to those skilled in the art that the present invention may be embodied in many other specific forms without departing from the spirit or scope of the invention.

For instance, the present invention may be embodied in a type of compressor which does not alter the inclining angle of the swash plate 25. In other words, the present invention may be embodied in a compressor which is not a variable type. In this case, the gas bleeding passage, which constantly communicates the suction chamber with the crank chamber, is formed in the bolt inserting holes.

The present invention may also be embodied in a compressor which employs a cam plate having a shape of a wave in lieu of the swash plate 25. In this case, the gas bleeding passage, which constantly communicates the suction chamber with the crank chamber, is formed in the bolt inserting holes.

The present invention may be embodied in a compressor in which the swash plate 25 and rotor 18 rotate integrally.

Furthermore, the present invention may also be embodied in a compressor in which the discharge volume is controlled by a valve controlling mechanism according to changes in the pressure within the discharge chamber.

Therefore, the present examples and embodiments are to be considered as illustrative and not restrictive and the invention is not to be limited to the details given herein, but may be modified within the scope of the appended claims.

What is claimed is:

1. A compressor including a cylinder block which has a cylinder bore and a plurality of bolt holes respectively receiving bolts to fix a front housing and a rear housing to the cylinder block and define a crank chamber, a suction chamber and a discharge chamber, said crank chamber accommodating a drive plate mounted on a drive shaft, wherein said drive plate converts a rotation of the drive shaft into a reciprocating movement of a piston in the cylinder bore to compress gas supplied to the cylinder bore from the suction chamber and discharge the compressed gas to the discharge chamber, said compressor comprising:

a first pressure passage connecting the suction chamber to the crank chamber, said first pressure passage being arranged to release excessive pressure in the crank chamber to the suction chamber so as to regulate the pressure in the crank chamber, said excessive amount being based on the gas compressed by the piston in the cylinder bore and leaked therefrom to the crank chamber;

said first pressure passage being partially defined by one of said bolt holes;

said drive plate being tiltable with respect to an axis of said drive shaft according to the pressure in the crank chamber with the tilting angle of the drive plate controlling the discharge volume of the compressor; and a second pressure passage connecting the crank chamber to the discharge chamber to transfer pressure in the discharge chamber to the crank chamber so as to adjust the pressure in the crank chamber;

said second pressure passage being partially defined by one of the bolt holes other than said one bolt hole that partially defines said first pressure passage.

2. The compressor as set forth in claim 1 further comprising a valve for selectively opening and closing the second pressure passage.

3. The compressor as set forth in claim 2 further comprising a pilot pressure passage for introducing one of the pressures in the crank chamber and suction chamber to the valve to selectively open and close the valve.

4. The compressor as set forth in claim 3, wherein said pilot pressure passage transfers the pressure from the crank chamber to the valve, and wherein said pilot pressure passage is partially defined by one of the bolt holes other than the bolt holes partially defining the first pressure passage and the second pressure passage.

5. The compressor as set forth in claim 3, wherein said pilot pressure passage transfers the pressure from the suction chamber to the valve, and wherein said pilot pressure passage is partially defined by one of the bolt holes other than the bolt holes partially defining the first pressure passage and the second pressure passage.

6. A compressor including a cylinder block which has a cylinder bore and a plurality of bolt holes respectively receiving bolts to fix a front housing and a rear housing to the cylinder block and define a crank chamber, a suction chamber and a discharge chamber, said crank chamber accommodating a drive plate mounted on a drive shaft, wherein said drive plate converts a rotation of the drive shaft into a reciprocating movement of a piston in the cylinder bore to compress gas supplied to the cylinder bore from the suction chamber and discharge the compressed gas to the discharge chamber, said compressor comprising:

a first pressure passage connecting the suction chamber to the crank chamber, said first pressure passage being arranged to release pressure in the crank chamber to the suction chamber so as to regulate the pressure in the crank chamber;

said first pressure passage being partially defined by one of the bolt holes;

said drive plate is tiltable with respect to an axis of said drive shaft according to the pressure in the crank chamber with the tilting angle of the drive plate controlling the discharge volume of the compressor;

a second pressure passage connecting the crank chamber to the discharge chamber to transfer pressure from the discharge chamber to the crank chamber so as to adjust the pressure in the crank chamber; and said second pressure passage being partially defined by one of the bolt holes other than the bolt hole partially defining the first pressure passage.

7. The compressor as set forth in claim 6, wherein said first pressure passage releases an excessive amount of the pressure in the crank chamber, said excessive amount being based on the gas compressed by the piston in the cylinder bore and leaked therefrom to the crank chamber.

8. The compressor as set forth in claim 7 further comprising a valve for selectively opening and closing the first pressure passage.

9. The compressor as set forth in claim 8 further comprising a pilot pressure passage for introducing one of the pressures in the crank chamber and suction chamber to the valve to selectively open and close the valve.

10. The compressor as set forth in claim 9, wherein said pilot pressure passage introduces the pressure in the crank chamber to the valve, and wherein said pilot pressure passage is partially defined by one of the bolt holes other than the bolt holes partially defining the first pressure passage and the second pressure passage.

11. The compressor as set forth in claim 9, wherein said pilot pressure passage transfers the pressure from the suction chamber to the valve, and wherein said pilot pressure passage is partially defined by one of the bolt holes other than the bolt holes partially defining the first pressure passage and the second pressure passage.

12. A compressor, used in a vehicle, including a cylinder block which has a cylinder bore and a plurality of bolt holes respectively receiving bolts to fix a front housing and a rear housing to the cylinder block and define a crank chamber, a suction chamber and a discharge chamber, said crank chamber accommodating a drive plate mounted on a drive shaft, wherein said drive plate converts a rotation of the drive shaft into a reciprocating movement of a piston in the cylinder bore to compress refrigerant gas supplied to the cylinder bore from the suction chamber and discharge the compressed refrigerant gas to the discharge chamber, said compressor comprising:

a first pressure passage partially defined by one of the bolt holes and connecting the suction chamber to the crank chamber, said first pressure passage being arranged to release an amount of excessive pressure from the crank chamber to the suction chamber so as to regulate the pressure in the crank chamber, said amount released being based on the gas compressed by the piston in the cylinder bore and leaked therefrom to the crank chamber;

said drive plate being arranged to be tiltable with respect to an axis of said drive shaft with the tilting angle of the drive shaft controlling the discharge volume of the compressor;

a second pressure passage defined by one of the bolt holes other than the bolt hole partially defining the first pressure passage and connecting the crank chamber to the discharge chamber to transfer pressure in the discharge chamber to the crank chamber so as to adjust the pressure in the crank chamber;

a valve for selectively opening and closing the second pressure passage; and a pilot pressure passage for transferring one of the pressures from the crank chamber and suction chamber to selectively open and close the valve.

13. The compressor as set forth in claim 12, wherein said pilot pressure passage transfers the pressure from the crank chamber to the valve, and wherein said pilot pressure passage is partially defined by one of the bolt holes other than the bolt holes partially defining the first pressure passage and the second pressure passage.

14. The compressor as set forth in claim 12, wherein said pilot pressure passage transfers the pressure from the suction chamber to the valve, and wherein said pilot pressure passage is partially defined by one of the bolt holes other than the bolt holes partially defining the first pressure passage and the second pressure passage.

15. A compressor including a cylinder block which has a cylinder bore and a plurality of bolt holes respectively receiving bolts to fix a front housing and a rear housing to the cylinder block and define a crank chamber, a suction chamber and a discharge chamber, said crank chamber accommodating a drive plate mounted on a drive shaft, wherein said drive plate converts a rotation of the drive shaft into a reciprocating movement of a piston in the cylinder bore to compress gas supplied to the cylinder bore from the suction chamber and discharge the compressed gas to the discharge chamber, said compressor comprising:

a first pressure passage connecting the suction chamber to the crank chamber, said first pressure passage being arranged to release an excessive amount of pressure in the crank chamber to the suction chamber so as to regulate the pressure in the crank chamber, said excessive amount being based on the compressed gas leaked from the cylinder bore to the crank chamber;

said drive plate being tiltable by a given angle with respect to an axis of said drive shaft according to the pressure in the crank chamber, and wherein said tilting angle controls the discharge volume of the compressor;

a second pressure passage connecting the crank chamber to the discharge chamber to transfer pressure in the discharge chamber to the crank chamber so as to adjust the pressure in the crank chamber; and said second pressure passage being partially defined by one of the bolt holes.

16. A compressor including a cylinder block which has a cylinder bore and a plurality of bolt holes respectively receiving bolts to fix a front housing and a rear housing to the cylinder block and define a crank chamber, a suction chamber and a discharge chamber, said crank chamber accommodating a drive plate mounted on a drive shaft, wherein said drive plate converts a rotation of the drive shaft into a reciprocating movement of a piston in the cylinder bore to compress gas supplied to the cylinder bore from the suction chamber and discharge the compressed gas to the discharge chamber, said compressor comprising:

a first pressure passage connecting the suction chamber to the crank chamber, said first pressure passage being arranged to release an excessive amount of pressure in the crank chamber to the suction chamber so as to regulate the pressure in the crank chamber, said excessive amount being based on the compressed gas leaked from the cylinder bore to the crank chamber;

said drive plate being tiltable by a given angle with respect to an axis of said drive shaft according to the pressure in the crank chamber, and wherein said tilting angle controls the discharge volume of the compressor;

a second pressure passage connecting the crank chamber to the discharge chamber to transfer pressure in the discharge chamber to the crank chamber so as to adjust the pressure in the crank chamber;

a valve for selectively opening and closing the second pressure passage;

a pilot pressure passage for introducing one of the pressures in the crank chamber and suction chamber to selectively open and close the valve; and at least one of said second pressure passage and said pilot pressure passage being partially defined by one of said bolt holes.

17. A compressor including a cylinder block which has a cylinder bore and a plurality of bolt holes respectively receiving bolts to fix a front housing and a rear housing to the cylinder block and define a crank chamber, a suction chamber and a discharge chamber, said crank chamber accommodating a drive plate mounted on a drive shaft, wherein said drive plate converts a rotation of the drive shaft into a reciprocating movement of a piston in the cylinder bore to compress gas supplied to the cylinder bore from the suction chamber and discharge the compressed gas to the discharge chamber, said compressor comprising:

a first pressure passage connecting the suction chamber to the crank chamber, said first pressure passage being arranged to release excessive pressure in the crank chamber to the suction chamber so as to regulate the pressure in the crank chamber, said first pressure passage being partially defined by one of said bolt holes;

said drive plate being tiltable with respect to an axis of said drive shaft according to the pressure in the crank chamber with the tilting angle of the drive plate controlling the discharge volume of the compressor; and a valve for selectively opening and closing said first pressure passage.

18. The compressor as set forth in claim 17, wherein said first pressure passage releases an amount of excessive pressure from the crank chamber, said amount released being based on the gas compressed by the piston in the cylinder bore and leaked therefrom to the crank chamber.

* * * * *